US006040064A

United States Patent [19]

Brück et al.

[11] Patent Number: 6,040,064

[45] Date of Patent: Mar. 21, 2000

[54] HONEYCOMB BODY WITH THERMAL INSULATION, PREFERABLY FOR AN EXHAUST GAS CATALYTIC CONVERTER

[75] Inventors: Rolf Brück, Bergisch Gladbach; Peter Hirth, Lohmar, both of Germany

[73] Assignee: Emitec Gesellschaft fuer Emissiontechnologies mbH, Lohmar, Germany

[21] Appl. No.: 09/286,689

[22] Filed: Apr. 5, 1999

Related U.S. Application Data

[63] Continuation of application No. PCT/EP97/05098, Sep. 17, 1997.

[30] Foreign Application Priority Data

Oct. 4, 1996 [DE] Germany ..... 196 41 049

[51] Int. Cl.[7] ..... B21D 39/00

[52] U.S. Cl. ..... 428/593; 428/116; 428/118; 428/604; 502/439; 422/174; 422/177; 422/180; 422/198; 422/221

[58] Field of Search ..... 428/116, 118, 428/604, 593; 502/439; 422/177, 198, 174, 180, 221

[56] References Cited

U.S. PATENT DOCUMENTS

| | | | |
|---|---|---|---|
| 4,022,019 | 5/1977 | Garcea | 60/282 |
| 5,419,876 | 5/1995 | Usui et al. | 422/177 |

FOREIGN PATENT DOCUMENTS

| | | |
|---|---|---|
| 0 229 352 A1 | 7/1987 | European Pat. Off. . |
| 38 33 675 A1 | 4/1990 | Germany . |
| 196 36 367 A1 | 3/1998 | Germany . |

OTHER PUBLICATIONS

International Publication No. WO 90/08249 (Maus et al.), dated Jul. 26, 1990.
International Publication No. WO 96/07021 (Maus et al.), dated Mar. 7, 1996.
International Publication No. WO 96/19647 (Wieres), dated Jun. 27, 1996.
International Publication No. WO 89/07488 (Maus et al.), dated Aug. 24, 1989.
International Publication No. WO 96/09892 (Bode et al.), dated Apr. 4, 1996.

*Primary Examiner*—Deborah Jones
*Assistant Examiner*—Abraham Bahta
*Attorney, Agent, or Firm*—Herbert L. Lerner; Laurence A. Greenberg

[57] ABSTRACT

A hhoneycomb body with thermal insulation, preferably for an exhaust gas catalytic converter, includes a plurality of honeycombs and thermal insulation having a plurality of stacked and/or wound insulating sheet layers which are mutually supported by microstructures provided in the insulating sheet layers so that intermediate spaces exist between the insulating sheet layers. The microstructures have a height of from 10 $\mu$m to 250 $\mu$m. The honeycomb body therefore has only slight heat losses to the environment.

34 Claims, 5 Drawing Sheets

HONEYCOMB BODY WITH THERMAL INSULATION, PREFERABLY FOR AN EXHAUST GAS CATALYTIC CONVERTER

CROSS-REFERENCE TO RELATED APPLICATIONS

This application is a continuation of copending International Application No. PCT/EP97/05098, filed Sep. 17, 1997, which designated the United States.

BACKGROUND OF THE INVENTION

Field of the Invention

The present invention relates to a honeycomb body having a plurality of honeycombs, preferably for use as a catalyst carrier body in motor vehicles. A coating of catalytic material applied to walls of the honeycombs permits conversion of exhaust gases from internal combustion engines.

International Publication No. WO 90/08249, corresponding to U.S. Pat. No. 5,157,010, as well as International Publication No. WO 96/09892, corresponding to U.S. patent application Ser. No. 08/824,443, filed Mar. 26, 1997 and U.S. Pat. No. 5,795,658, describe honeycomb bodies with macrostructures which determine the honeycomb form. The honeycomb bodies additionally have microstructures which influence the flow of exhaust gas passing through the honeycombs.

Honeycomb walls of the bodies are formed of, for example, of metal. A possible way of producing honeycomb bodies with such honeycomb walls includes brazing or welding. Suitable kinds of welds are known, for example, from International Publication No. WO 89/07488.

It is known from European Patent Application 0 229 352 A1 to use a heat radiation guard or protection device. The heat radiation guard or protection device includes one or more sheet layers which are disposed outside a tubular casing. That configuration uses the same sheet layers which also form the honeycomb structure within the tubular casing.

Particularly in the automobile industry, the requirements imposed in terms of the properties of an exhaust gas catalytic converter are becoming ever increasingly strict. In the course of ever increasing strictness in relation to exhaust gas standards, the cold-start and re-start characteristics in particular have to be continually improved. When an engine is re-started after a stoppage time, it is important that the honeycomb body of the catalytic converter still be at a temperature which is as high as possible. International Publication No. WO 96/07021, corresponding to U.S. patent application Ser. No. 08/808,784, filed Feb. 28, 1997, describes a catalytic reactor for the conversion of exhaust gases which has a thermal insulation both within as well as outside a casing. An air gap and an insulating mat are mentioned as examples of such insulations.

In the above-mentioned state of the art, the insulation effect is achieved by air or through the use of a solid insulation material. Admittedly air at rest has a lower level of thermal conductivity than known solid insulating materials, but it only impedes the transportation of heat due to radiation to an extremely slight degree. In contrast, a plurality of sheet layers, as have been proposed in International Publication No. WO 96/07021, corresponding to U.S. patent application Ser. No. 08/808,784, filed Feb. 28, 1997, considerably reduces the amount of heat radiation. However, due to their contact locations, the sheet layers form thermal bridges, with the result that once again a considerable degree of heat transportation can occur due to heat conduction.

SUMMARY OF THE INVENTION

It is accordingly an object of the invention to provide a hhoneycomb body with thermal insulation, preferably for an exhaust gas catalytic converter, which overcomes the hereinafore-mentioned disadvantages of the heretofore-known devices of this general type and which only has low heat losses to the environment.

With the foregoing and other objects in view there is provided, in accordance with the invention, a honeycomb body, especially a catalytic converter for the conversion of exhaust gases, in particular exhaust gases from internal combustion engines, particularly Otto-cycle engines, comprising a multiplicity of honeycombs; and a thermal insulation having a plurality of stacked and/or wound insulating sheet layers; the insulating sheet layers having microstructures mutually supporting the insulating sheet layers and defining intermediate spaces between the insulating sheet layers, the microstructures having a height of from 15 $\mu$m to 250 $\mu$m.

The microstructures are therefore substantially lower than the structures known from European Patent Application 0 229 352 A1 for forming honeycomb-like passages through which exhaust gas can flow. Microstructures of that height are known from International Publication No. WO 96/09892, corresponding to U.S. patent application Ser. No. 08/824,443, filed Mar. 26, 1997 and U.S. Pat. No. 5,795,658, in which they have been proposed for intermixing exhaust gas flowing in a laminar flow in the honeycomb-like passages. However, in the case of a honeycomb body according to the invention, the properties of such microstructures are used in a completely different manner. Due to their small height it is possible for a multiplicity of insulating sheet layers to be disposed in mutually stacked or stratified relationship in a small space, whereby heat transportation due to heat radiation through the stack is considerably reduced. Since the reduction depends to a good approximation solely on the number of insulating sheet layers, it is possible to save space or achieve a higher level of insulation effect, in comparison with the state of the art.

However, the greater stack density has still another advantage. The contact surface area between each two insulating sheet layers can be considerably reduced by virtue of a suitable configuration of the microstructures, for example in such a way that they have narrow, sharp-edged crests or ridges. In that way it is also possible to markedly reduce the transmission of heat due to heat conduction.

In particular, in order to effectively protect the honeycomb body with its plurality of honeycombs from heat losses, it is desirable if the insulating sheet layers enclose the honeycombs in an as closed a configuration as possible. It will be appreciated that in the case of honeycomb bodies for use as exhaust gas catalyst carrier bodies, openings for the intake and outlet of exhaust gas have to be kept free.

However, in a particular configuration the nature of a thermal insulation, in accordance with the invention, is also suitable for protecting heat-sensitive articles in the vicinity of a honeycomb body. In accordance with another feature of the invention, in that case the thermal insulation only partially encloses the honeycombs so that a thermal insulation effect is achieved in solid angle regions which are limited, as viewed from the honeycombs.

In accordance with a further feature of the invention, the insulating sheet layers of the thermal insulation are at least partially connected together by a procedure involving the intimate joining of the materials, preferably brazing or welding. The mechanical stability of the thermal insulation, which can be achieved in that way is an advantage.

In accordance with an added feature of the invention, the honeycombs have metal honeycomb walls. In alternative configurations in which insulating sheet layers adjoining the honeycombs are also metal, brazed or welded connections of the honeycombs to each other and of honeycombs to insulating sheet layers can be produced at the same time in the same brazing or welding process.

However, as an alternative other materials such as ceramic materials are also used for the honeycomb walls, or different materials are combined. A particular configuration is achieved if insulating sheet layers are applied to a green ceramic with a plurality of honeycombs and then the ceramic is fired. In an alternative configuration thereof the insulating sheet layers are secured to the green ceramic by virtue of their microstructures since they are impressed into the green ceramic.

In accordance with an additional feature of the invention, in the case of metal honeycomb walls, the requirements made in regard to the resistance to corrosion thereof are high. A honeycomb body according to the invention which is suitably provided with catalytically active material is suitable for the conversion of exhaust gases of an internal combustion engine, in particular an Otto-cycle engine. The exhaust gas temperature of such engines is typically over 800° C. A honeycomb body for that purpose of use must withstand corrosion phenomena at those temperatures over thousands of operating hours. However, the same requirements do not have to be made in terms of the thermal insulation. The thermal insulation is not exposed to such high temperatures as the honeycomb walls. With a good insulation effect, at most the insulating sheet layers adjacent the honeycomb walls reach similarly high temperatures. In a preferred embodiment of a honeycomb body according to the invention the thermal insulation also does not come into contact with corrosive gases, particularly in an embodiment in which the thermal insulation is closed off in relation to any intake of gas into the intermediate spaces.

In accordance with yet another feature of the invention, the honeycomb body has a tubular casing, in the tubular interior of which the honeycombs are disposed. Such a configuration is advantageous for reasons of mechanical stability as well as for reasons relating to manufacturing procedure. There are various different configurations of such a honeycomb body. In one of them a thermal insulation as described above is also disposed in the tubular interior.

In accordance with yet a further feature of the invention, in other alternative configurations, instead or in addition, such a thermal insulation is disposed outside the tubular casing.

In accordance with yet an added feature of the invention, an outermost insulating sheet layer is particularly thick or a second outer tubular casing is provided, which affords protection from mechanical damage. In the case of alternative constructions involving metal tubular casings, connections between thermal insulation and the tubular casings are advantageously at least partially brazed or welded.

In accordance with yet an additional feature of the invention, the insulating sheet layers of the thermal insulation are parts of a continuous sheet strip which is wound in a spiral.

In accordance with still another feature of the invention, the thermal insulation has precisely two sheet strips, with the microstructures being provided in at least one. The two sheet strips are twisted together in a spiral winding. Such a winding configuration can be produced, for example, by the two sheet strips firstly being laid one upon the other, then secured at one end to each other and/or to another part of the honeycomb body, for example to a tubular casing, and then wound. Other variants use more than two sheet strips. Spiral windings are advantageous inter alia for the reason that they are particularly easy to produce. It is, however, also possible to use annular insulating sheet layers which are closed in themselves. Completely different shapes with respect to the thermal insulation are also possible for specific purposes, while retaining the construction principle involved. In order to protect individual sensitive items outside the honeycomb body from heat radiation, a stack of slightly bent insulating sheet layers is disposed, for example, on a limited part of the surface of the honeycomb body.

In accordance with still a further feature of the invention, the honeycombs are at least partially heatable. The heatable region can be rapidly brought without substantial heat losses to a desired operating temperature by virtue of the thermal insulation. The thermal insulation helps to ease the load on the power source, for example a battery of a motor vehicle.

In accordance with still an added feature of the invention, the thermal insulation has ends at which there are edges of a plurality of insulating sheet layers. If, for example, air flows against an end of such a honeycomb body, then an undesirable cooling action can occur due to an air flow through the intermediate spaces. In a desirable development therefore the insulating sheet layers are at least partially connected together in the proximity of the end or the ends so that a flow of air or another flow of gas between the intermediate spaces and the atmosphere surrounding the thermal insulation is impeded or blocked. For example, the insulating sheet layers are brazed or welded together in the proximity of the end, they are provided with a filling material at the end, or an additional closure portion is mounted at the end.

In accordance with still an additional feature of the invention, the efficiency of a thermal insulation configuration is increased by the intermediate spaces between the insulating sheet layers being all or partially sealed off in relation to air, and evacuated. Besides the reduction in overall thermal conductivity, that also prevents the penetration under some circumstances of corrosive gases into the thermal insulation.

In accordance with again another feature of the invention, the heat radiation within the thermal insulation and/or the radiant heat emission from the honeycomb body outwardly is further reduced if at least a part of the insulating sheet layers of the thermal insulation, in particular at least one outer insulating sheet layer, is provided with a surface which has a degree of emission of less than 0.1.

In accordance with again a further feature of the invention, in one embodiment, the insulating sheet layers are formed throughout of a material with the desired emission properties, while in another embodiment, disposed at the surface is a material layer being formed of a different material from the predominant part of the insulating sheet layer in other respects. The layer may, for example, be applied by vapour deposition.

In accordance with again an added feature of the invention, the microstructures of at least one and preferably all of the insulating sheet layers with the microstructures have at least one array of ridges extended line-like in a mutually parallel relationship.

In accordance with again an additional feature of the invention, the microstructures of the at least one array are disposed at spacings of between 1 mm and 20 mm and preferably from 5 to 15 mm from each other.

In accordance with another feature of the invention, the at least one array of the microstructures is two arrays with ridges extending in mutually crossed directions.

In accordance with a concomitant feature of the invention, the at least one pair of the insulating sheet layers has at least one common intermediate space, and the layers of the pair are mutually supported by one array having the ridges extending in mutually crossed directions.

Other features which are considered as characteristic for the invention are set forth in the appended claims.

Although the invention is illustrated and described herein as embodied in a hhoneycomb body with thermal insulation, preferably for an exhaust gas catalytic converter, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DESCRIPTION OF THE PREFERRED EMBODIMENTS

Figure 1:
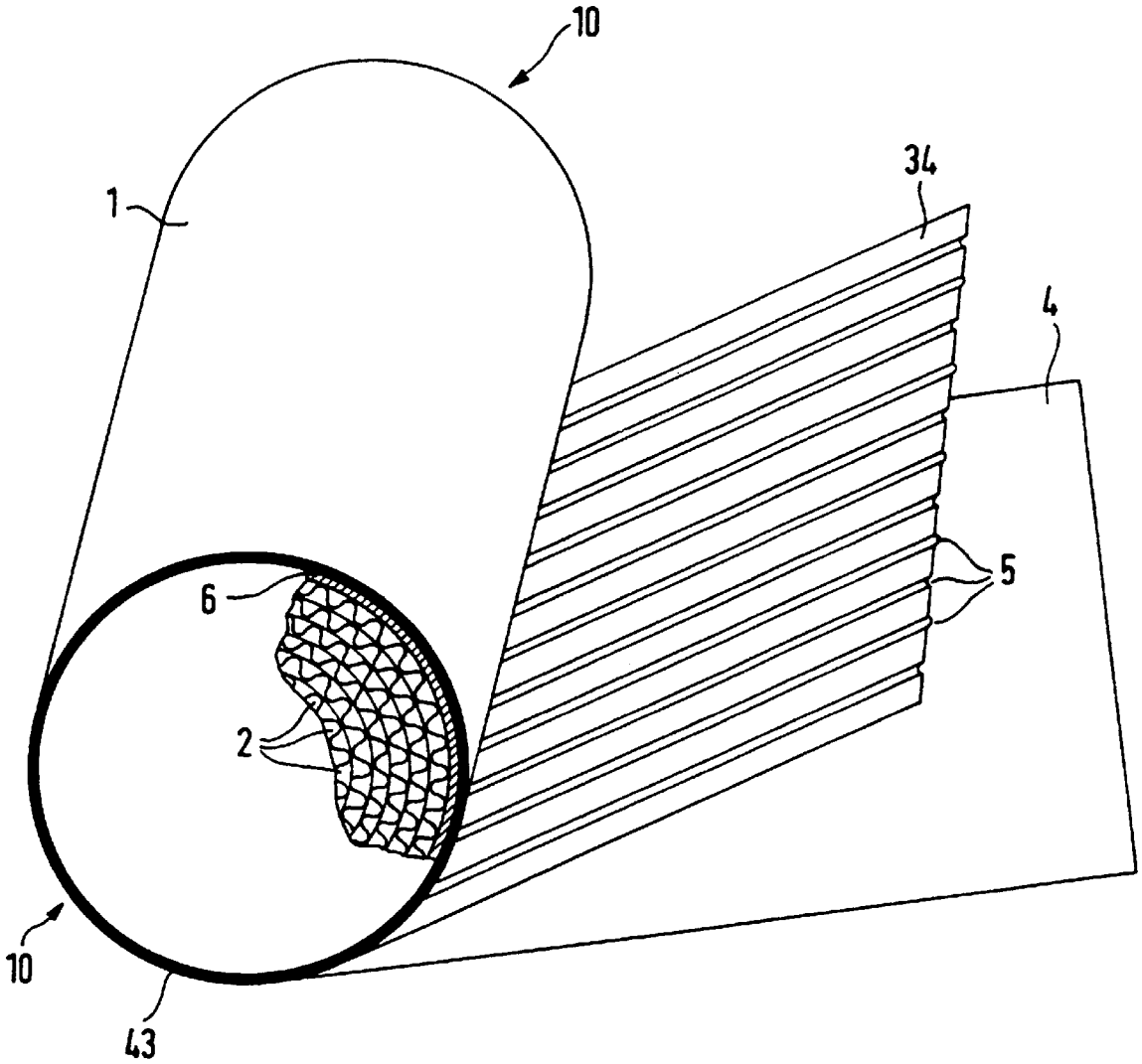
FIG. 1 is a diagrammatic, perspective view of a cylindrical honeycomb body with a wound thermal insulation.

Referring now to the figures of the drawings in detail and first, particularly, to FIG. 1 thereof, there is seen a preferred embodiment of a honeycomb body 1 according to the invention. A core of the honeycomb body includes a plurality of honeycombs 2 which are formed by wound smooth and corrugated sheet layers. The honeycombs form passages interconnecting ends 10 of the sheet layers. The core is encompassed by a cylindrical tubular casing 6 which in turn is encompassed by a thermal insulation 43. In this embodiment the thermal insulation 43 has insulating sheet layers including one smooth layer 4 and another layer 34 which is microstructured at two sides as indicated at reference numeral 5. FIG. 1 shows a snapshot at a moment just before the two insulating sheet layers 4 and 34 are wound completely around the core.

Figure 2:
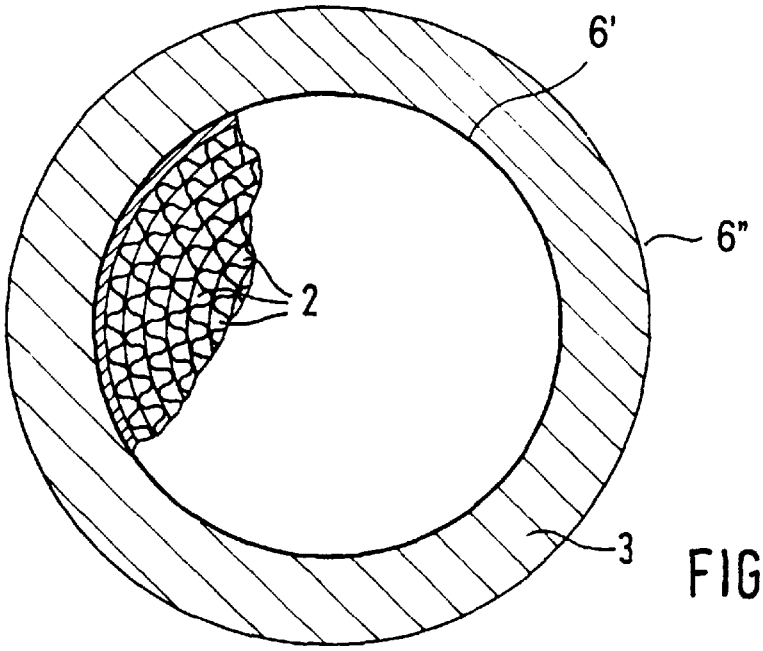
FIG. 2 is a cross-sectional view through a honeycomb body with two tubular casings.

FIG. 2 shows a honeycomb body with a core as in FIG. 1, which is encompassed by an inner tubular casing 6'. Thermal insulation 3 which externally adjoins the inner tubular casing 6' is of substantially greater thickness than in the embodiment shown in FIG. 1, in relation to the diameter of the core. The thermal insulation 3 is encompassed by a second, outer tubular casing 6".

Figure 3:
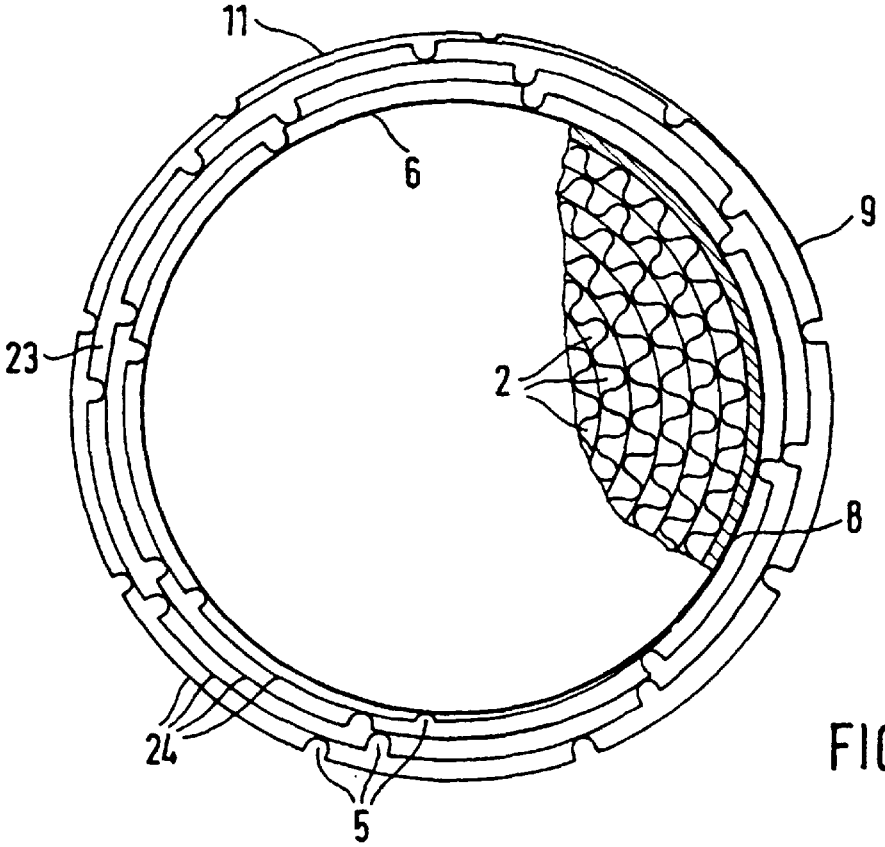
FIG. 3 is a cross-sectional view through a honeycomb body with a thermal insulation formed of a sheet strip.

FIG. 3 shows a specific structure of a thermal insulation 23. Insulating sheet layers 24 are parts of a continuous, spirally wound sheet strip 11 with microstructures 5 which are raised at an inward side of the sheet strip 11. The sheet strip 11 is connected at its beginning 8 to the tubular casing 6. The sheet strip 11 is secured to another portion of itself at its end 9.

Figure 4:
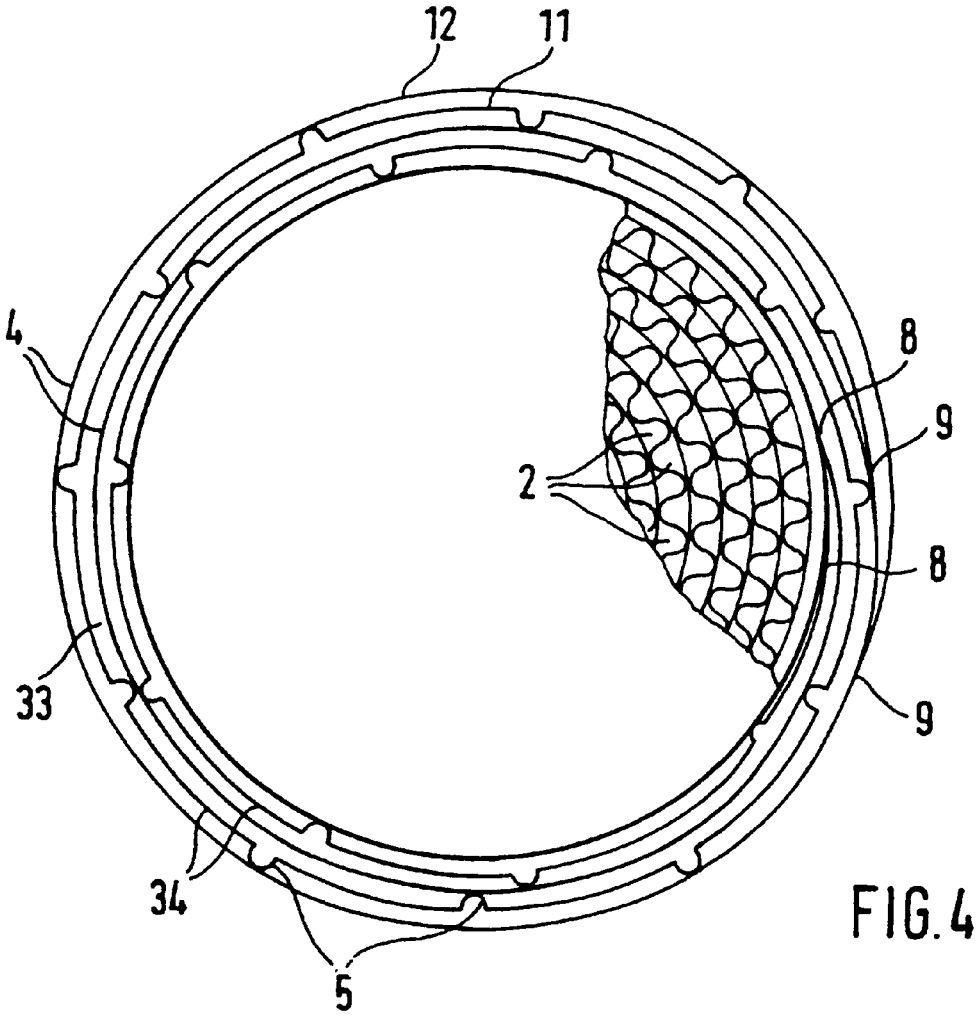
FIG. 4 is a cross-sectional view through a honeycomb body with a thermal insulation formed of two sheet strips.

FIG. 4 shows another possible structure of a thermal insulation. This structure is similar to that shown in FIG. 1 but in this case the microstructures 5 of the sheet strip 11 extend in a direction approximately parallel to the passages whereas in the example of FIG. 1 they extend approximately transversely relative thereto. In contrast to the thermal insulation 23 in FIG. 3, a thermal insulation 33 of FIG. 4 has two sheet strips 11, 12, including one sheet strip 12 which is smooth, that is to say it does not have any microstructures 5.

Figure 5:
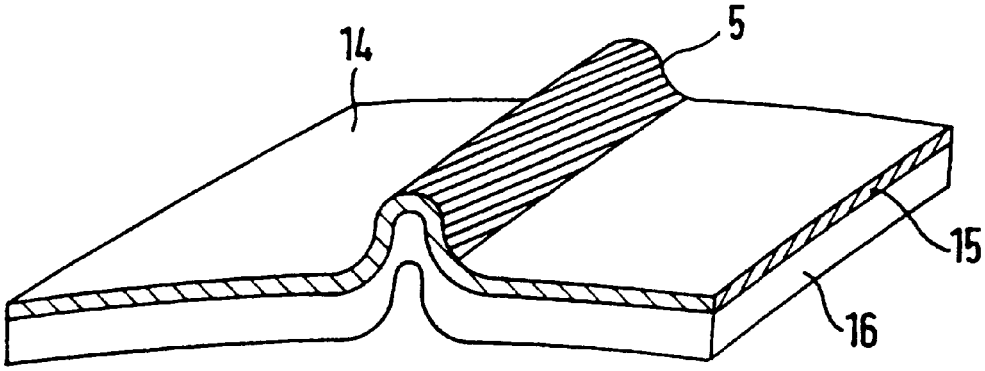
FIG. 5 is a fragmentary, perspective view of a portion of an insulating sheet layer with a microstructure and with an anti-emission layer.

Details concerning two different ways of producing an insulating sheet layer 14 are explained with reference to FIG. 5. The insulating sheet layer 14 is of approximately the same thickness at its microstructure 5 as elsewhere. Such a microstructure is produced, for example, by bending or stamping the insulating sheet layer 14. Another possible way of producing the microstructures involves applying additional material to an insulating sheet layer. The insulating sheet layer 14 is built up in a laminate manner. A thinner anti-emission layer 15 forms a continuous surface on one side of the insulating sheet layer 14. It is carried by a base material 16. The anti-emission layer 15 can be applied, for example, galvanically to the base material 16.

Figure 6:
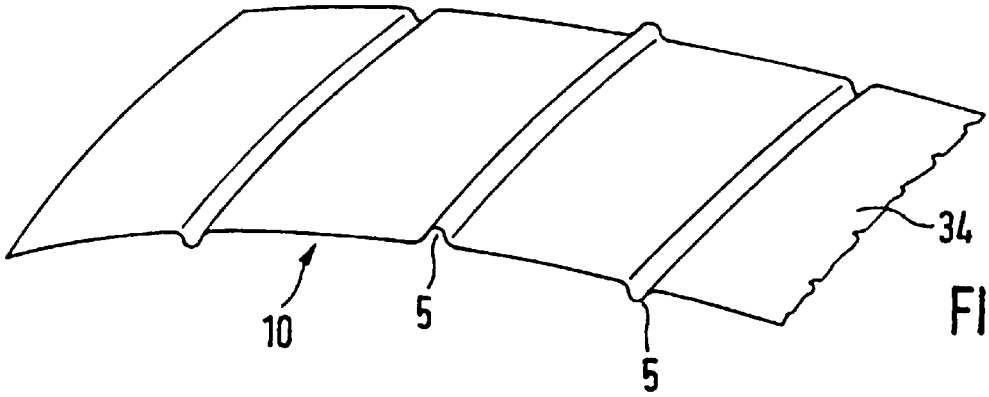
FIG. 6 is a fragmentary, perspective view of an insulating sheet layer with parallel microstructures which are raised towards both sides of the insulating sheet layer.

FIG. 6 shows an insulating sheet layer 34 in which the microstructures 5 have an array of ridges or crests that extend line-like in a mutually parallel relationship. Ridges or crests are raised alternately towards both sides of the insulating sheet layer 34. The microstructures 5 meet the end or edge 10 of the insulating sheet layer 34 in a perpendicular relationship.

A particularly advantageous structure for a thermal insulation 3 can be achieved by combining such an insulating sheet layer 34 with insulating sheet layers of the same kind. When that is done the insulating sheet layers are stacked one upon the other with their ridges or crests extending in mutually crossed directions. The ridges or crests which extend in mutually crossed relationship only contact each other at approximately point-like contact locations at double the spacing of the parallel microstructures 5. Contact locations of an insulating sheet layer 34 in relation to a lower and an upper neighbour in the stack are disposed at the spacing of the parallel microstructures 5. Values of between 1 mm and 20 mm are advantageous in terms of the spacings of parallel microstructures, with values of between 5 mm and 15 mm being preferred. Heat which is conducted in a general direction perpendicularly to the insulating sheet layers 34 therefore flows along considerable detour routes. By virtue of those detour routes and by virtue of the point-like contact locations, the level of thermal insulation effect that is achieved is particularly high.

Figure 7:
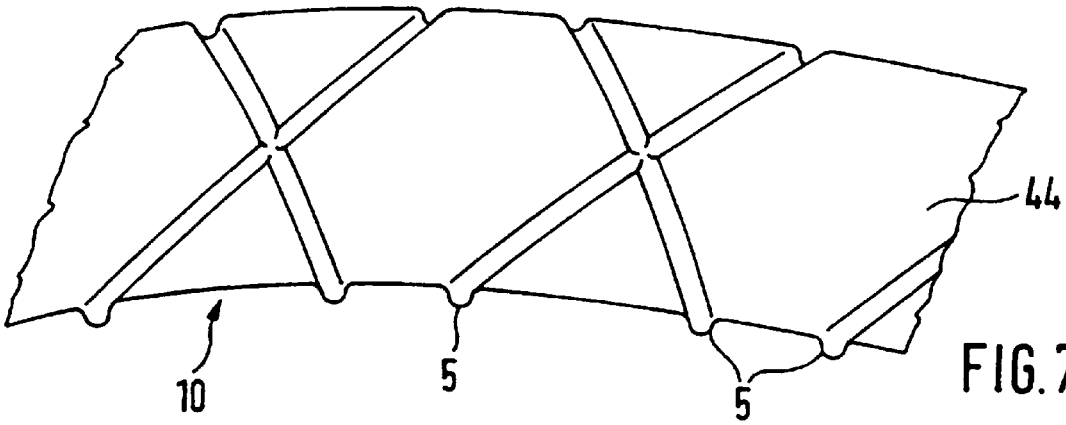
FIG. 7 is a fragmentary, perspective view of an insulating sheet layer with crossed microstructures.
Figure 8:
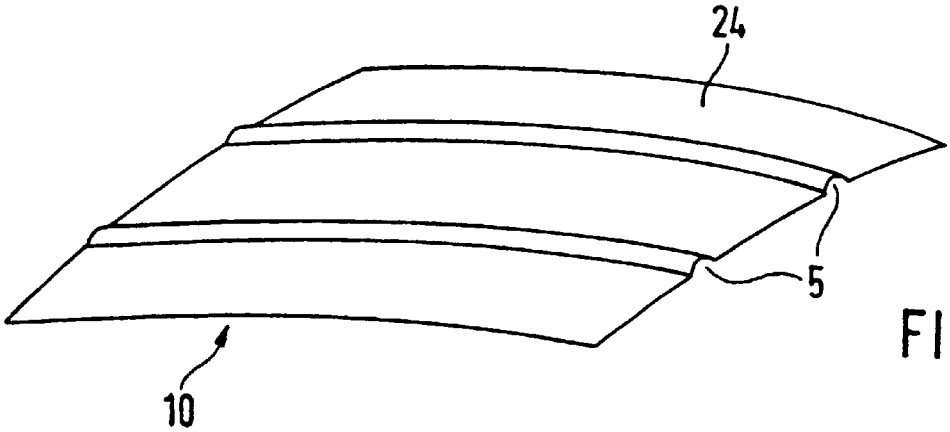
FIG. 8 is a fragmentary, perspective view of an insulating sheet layer with microstructures parallel to an end edge.

The embodiment of an insulating sheet layer 44 with microstructures 5 shown in FIG. 7 is mechanically particularly stable because of the ridges or crests which extend in mutually crossed directions. Depending on the desired bending radius, it can possibly be bent only in given directions and wound around a honeycomb body core. Since the crests or ridges are raised towards precisely one side of the insulating sheet layer 44, the insulating sheet layer 44 is advantageously combined on the other side with insulating sheet layers 14, 24, 34, 44 which also have microstructures. A combination with insulating sheet layers without microstructures would result, on one side, in contact over an undesirably large surface area. An advantageous combination is in particular that with insulating sheet layers 14, 24, 34 in which the overall image of the microstructures differs in terms of the shape, angle of intersection and/or spacing of the microstructures, from the overall image of the insulating sheet layer 44. In that way it is possible to prevent the microstructures of one insulating sheet layer from engaging in a form-locking relationship into the microstructures of another insulating sheet layer. A form-locking connection is one which connects two elements together due to the shape of the elements themselves, as opposed to a force-locking connection, which locks the elements together by force external to the elements. FIG. 8 shows an insulating sheet layer 24 with microstructures 5, which is suitable for an advantageous combination with the insulating sheet layer shown in FIG. 7.

Figure 9:
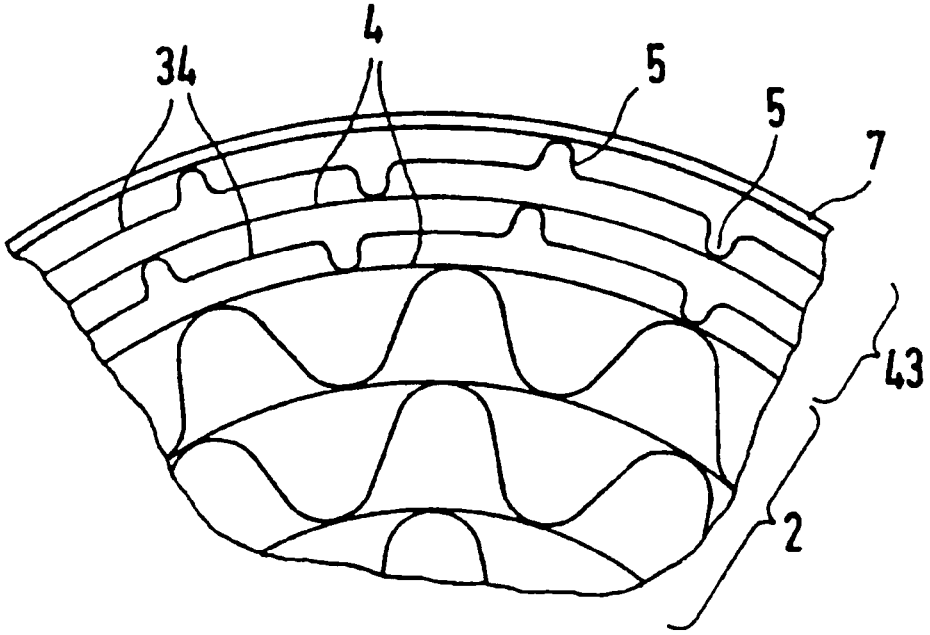
FIG. 9 is a fragmentary, cross-sectional view through a honeycomb body with a heat insulation formed of insulating sheet layers with and without microstructures.
Figure 10:
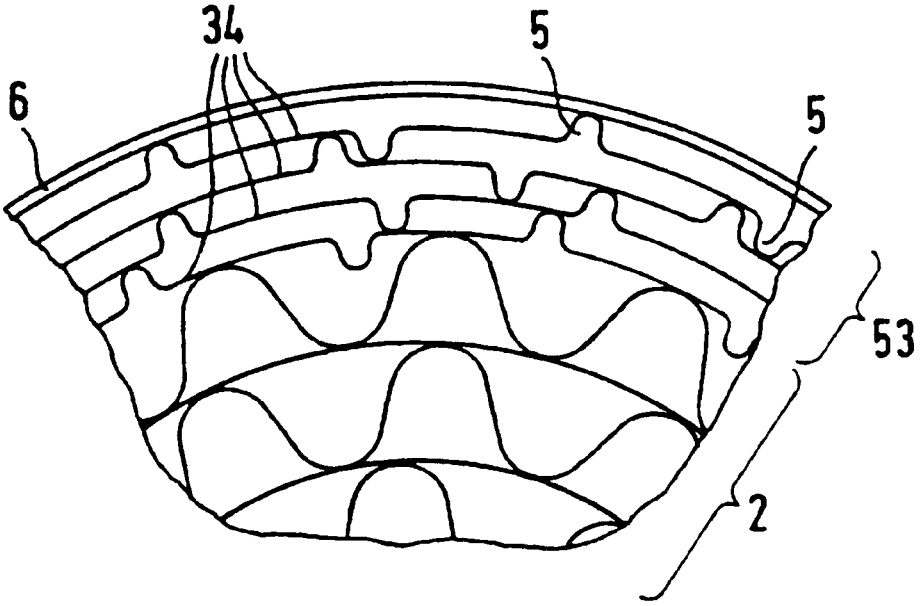
FIG. 10 is a fragmentary, cross-sectional view through a honeycomb body with a thermal insulation having insulating sheet layers which are microstructured on two sides.

FIGS. 9 and 10 each show sectional views of respective portions of a honeycomb body core and a thermal insulation 43, 53. A transition from the core to the thermal insulation 43, 53 is accomplished by way of an insulating sheet layer 4 without microstructures in FIG. 9, or by way of an insulating sheet layer 34 with microstructures in FIG. 10. The insulating sheet layers 4, 34 each form a respective stack, but with a different stacking sequence. In FIG. 10 all of the insulating sheet layers 34 are microstructured on both sides. In FIG. 9 the insulating sheet layers 34 with the microstructures have at least one insulating sheet layer 4 without microstructures as the closest successive neighbour.

The cylindrical spatial configuration shown in FIG. 1 or the circular cross-sections shown in the other figures are in no way the only options with regard to the shape of a honeycomb body according to the invention. Examples of other shapes are a conical spatial configuration or a polygonal cross-section. A thermal insulation 3, 23, 33, 43, 53 with microstructured insulating sheet layers may also be disposed differently relative to honeycombs 2 from the configurations shown in the figures. For example, the thermal insulation may only semilaterally encompass the honeycombs 2 or the honeycombs 2 may also be disposed outside of the thermal insulation.

We claim:

1. A honeycomb body, comprising:

a multiplicity of honeycombs; and a thermal insulation having a plurality of at least one of stacked and wound insulating sheet layers;

said insulating sheet layers having microstructures mutually supporting said insulating sheet layers and defining intermediate spaces between said insulating sheet layers, said microstructures having a height of from 15 $\mu$m to 250 $\mu$m.

2. The honeycomb body according to claim 1, wherein said thermal insulation only partially surrounds said honeycombs.

3. The honeycomb body according to claim 1, wherein said insulating sheet layers are at least partially connected together by joining.

4. The honeycomb body according to claim 1, wherein said insulating sheet layers are at least partially connected together by brazing.

5. The honeycomb body according to claim 1, wherein said honeycombs have metal honeycomb walls formed by wound smooth and corrugated sheet layers.

6. The honeycomb body according to claim 5, wherein said metal honeycomb walls are at least partially connected together by joining.

7. The honeycomb body according to claim 5, wherein said metal honeycomb walls are at least partially connected together by brazing.

8. The honeycomb body according to claim 5, wherein said metal honeycomb walls and said insulating sheet layers are formed of different materials.

9. The honeycomb body according to claim 5, wherein said metal honeycomb walls are formed of a material resistant to corrosion at temperatures over 800° C. and said insulating sheet layers are formed of a material less resistant to corrosion.

10. The honeycomb body according to claim 5, wherein a part of said honeycomb walls is connected to at least one of said insulating sheet layers by joining.

11. The honeycomb body according to claim 5, wherein a part of said honeycomb walls is connected to at least one of said insulating sheet layers by brazing.

12. The honeycomb body according to claim 1, including a tubular casing having a tubular interior in which said honeycombs are disposed.

13. The honeycomb body according to claim 1, including a tubular casing, said thermal insulation disposed outside said tubular casing.

14. The honeycomb body according to claim 1, wherein said insulating sheet layers include inner insulating sheet layers and an outermost insulating sheet layer thicker than said inner insulating sheet layers.

15. The honeycomb body according to claim 1, including a tubular casing having a tubular interior in which said thermal insulation is disposed.

16. The honeycomb body according to claim 1, wherein said insulating sheet layers are parts of a continuous, spirally wound sheet strip.

17. The honeycomb body according to claim 1, wherein said thermal insulation includes two sheet strips, said microstructures are formed in at least one of said sheet strips, and said two sheet strips are twisted together in a spiral winding.

18. The honeycomb body according to claim 1, wherein said honeycombs at least partially have heatable walls.

19. The honeycomb body according to claim 1, wherein said insulating sheet layers have edges, said thermal insulation has an end at which said edges of a plurality of said insulating sheet layers are disposed, and said insulating sheet layers are at least partially connected together in the vicinity of said end for impeding or blocking an air flow between said intermediate spaces and the surroundings of said thermal insulation.

20. The honeycomb body according to claim 1, wherein at least part of said intermediate spaces are sealed off relative to air and evacuated.

21. The honeycomb body according to claim 1, wherein at least a part of said insulating sheet layers has an emission degree of less than 0.1 for an emission of heat radiation.

22. The honeycomb body according to claim 1, wherein at least one of said insulating sheet layers at an outward side of said thermal insulation has an emission degree of less than 0.1 for an emission of heat radiation.

23. The honeycomb body according to claim 22, wherein said at least one insulating sheet layer at said outward side of said thermal insulation has a predominant part and a surface, an anti-emission material layer is disposed at said surface, and said anti-emission material layer is formed of a different material than said predominant part.

24. The honeycomb body according to claim 1, wherein said microstructures of at least one of said insulating sheet layers with said microstructures have at least one array of ridges extended line-like in a mutually parallel relationship.

25. The honeycomb body according to claim 1, wherein said microstructures of all of said insulating sheet layers with said microstructures have at least one array of ridges extended line-like in a mutually parallel relationship.

26. The honeycomb body according to claim 24, wherein said microstructures of said at least one array are disposed at spacings of between 1 mm and 20 mm from each other.

27. The honeycomb body according to claim 25, wherein said microstructures of said at least one array are disposed at spacings of between 1 mm and 20 mm from each other.

28. The honeycomb body according to claim 24, wherein said microstructures of said at least one array are disposed at spacings of from 5 to 15 mm from each other.

29. The honeycomb body according to claim 25, wherein said microstructures of said at least one array are disposed at spacings of 5 to 15 mm from each other.

30. The honeycomb body according to claim 24, wherein said at least one array of said microstructures is two arrays with ridges extending in mutually crossed directions.

31. The honeycomb body according to claim 25, wherein said at least one array of said microstructures is two arrays with ridges extending in mutually crossed directions.

32. The honeycomb body according to claim 24, wherein at least one pair of said insulating sheet layers has at least one common intermediate space, and said layers of said pair are mutually supported by one array having said ridges extending in mutually crossed directions.

33. The honeycomb body according to claim 25, wherein at least one pair of said insulating sheet layers has at least one common intermediate space, and said layers of said pair are mutually supported by one array having said ridges extending in mutually crossed directions.

34. A catalytic converter for the conversion of exhaust gases, comprising:

a multiplicity of honeycombs; and a thermal insulation having a plurality of at least one of stacked and wound insulating sheet layers;

said insulating sheet layers having microstructures mutually supporting said insulating sheet layers and defining intermediate spaces between said insulating sheet layers, said microstructures having a height of from 15 $\mu$m to 250 $\mu$m.

* * * * *